United States Patent [19]

Riefler

[11] 4,098,040

[45] * Jul. 4, 1978

[54] CONCRETE BLOCK PANEL

[76] Inventor: Monte Riefler, P.O. Box 210, Hamburg, N.Y. 14075

[ * ] Notice: The portion of the term of this patent subsequent to Jan. 11, 1994, has been disclaimed.

[21] Appl. No.: 740,095

[22] Filed: Nov. 9, 1976

Related U.S. Application Data

[63] Continuation-in-part of Ser. No. 539,774, Jan. 9, 1975, Pat. No. 4,001,988.

[51] Int. Cl.[2] ..... E04G 21/00; E04C 1/02

[52] U.S. Cl. ..... 52/125; 52/404

[58] Field of Search ..... 52/125, 404, 561, 572

[56] References Cited

U.S. PATENT DOCUMENTS

| | | | |
|---|---|---|---|
| 3,079,730 | 3/1963 | Donegan | 52/443 |
| 3,999,349 | 12/1976 | Miele | 52/404 X |
| 4,001,988 | 1/1977 | Riefler | 52/125 |

*Primary Examiner*—J. Karl Bell

*Attorney, Agent, or Firm*—Ralph Hammar

[57] ABSTRACT

A concrete block panel with mortarless joints in which the blocks are held together in vertical and horizontal compression by steel strapping and are reenforced by external coatings of glass fiber cement. The blocks may be insulated by urethane foam board sandwiched between the outer surface of the panel and external facing blocks. The blocks may also be used with mortar joints. The urethane foam board insulation assists in laying the blocks with either dry or mortar joints.

13 Claims, 12 Drawing Figures

CONCRETE BLOCK PANEL

This application is a continuation in part of application Ser. No. 539,774, filed Jan. 9, 1975 now U.S. Pat. No. 4,001,988, incorporated by reference.

This invention is a modular concrete block wall panel which is prefabricated by the block manufacturer and delivered to the construction site in modular sizes such as, for example, 8–10 feet high by 8–20 feet in length. In steel frame buildings the panels may be received in vertical steel channels and are dropped in place by the same cranes which erect the steel so that at the end of the steel erection the entire building wall is completed with a negigible addition to the steel erection time. The block may be thermally insulated and may be laid dry or with mortar joints.

In the drawing

Figure 5:
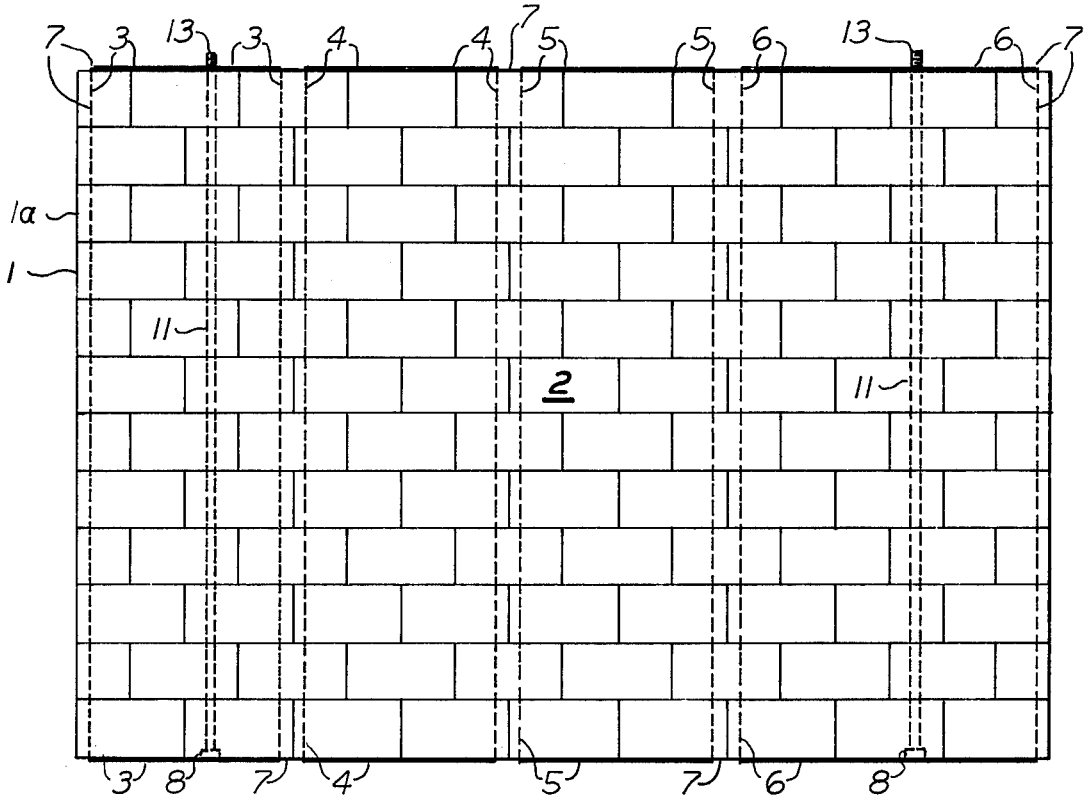
Figure 8:
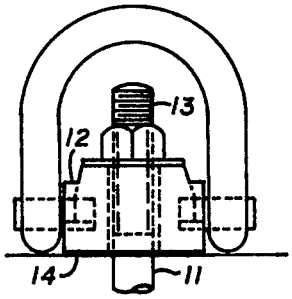
Figure 7:
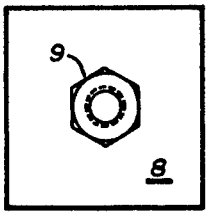
Figure 6:
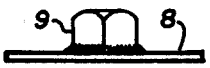

FIG. 5 is an elevation of the panel after the blocks are laid up and the lifting rods and steel strapping installed and before the outer surfaces of the panel are plastered with a glass fiber cement mixture, FIG. 6 is an enlarged section of a pick up base used for the lower ends of the panel pick up rods, FIG. 7 is a top view of the pick up base, FIG. 8 is an elevation of the lifting swivel attached to the upper end of the pick up rod.

Figure 9:
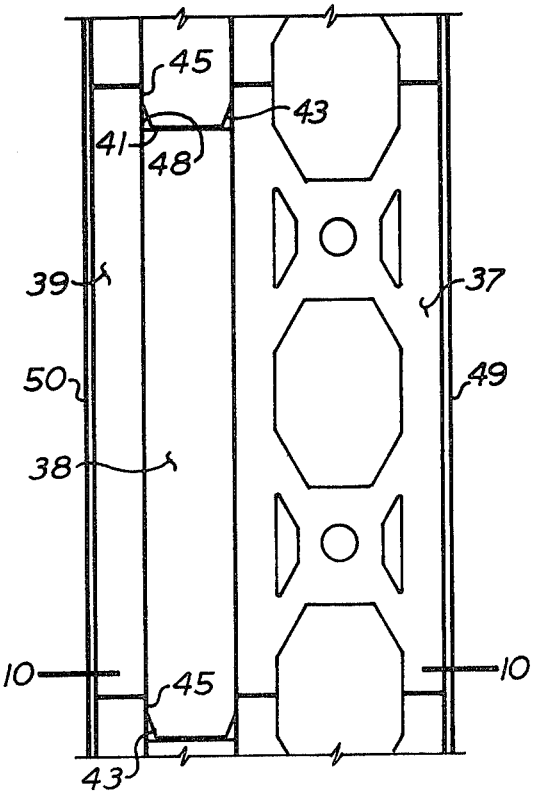
Figure 10:
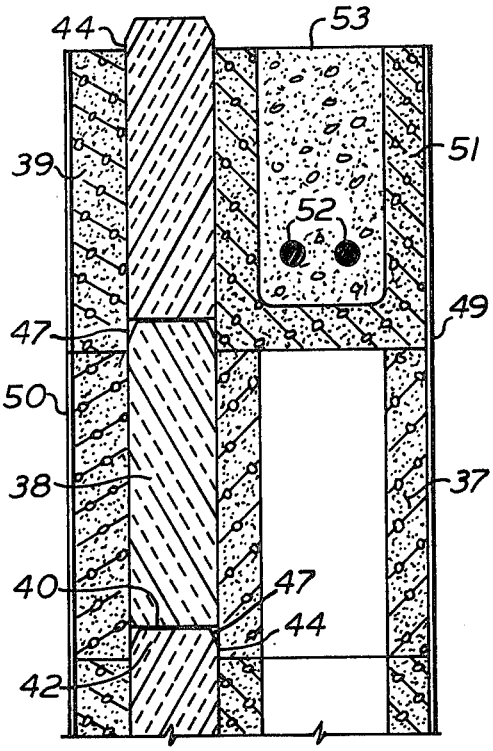

FIG. 9 is a plan view of an insulated block,

FIG. 10 is a section on line 10—10 of FIG. 9, and

Figure 11:
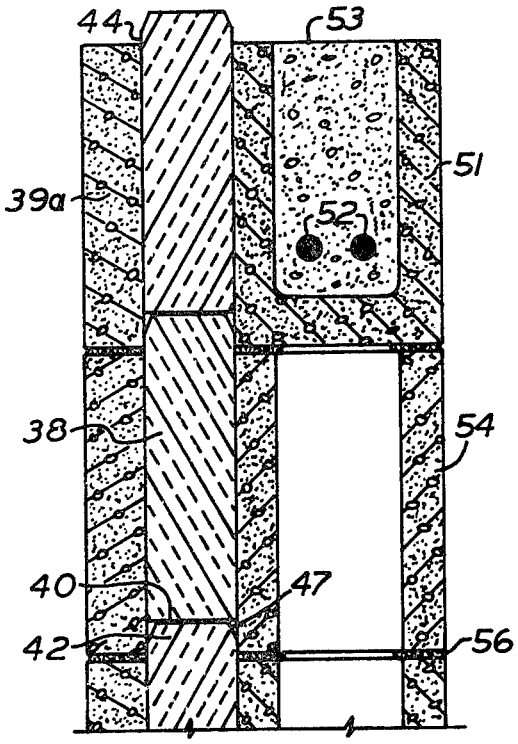

FIG. 11 is a view similar to FIG. 10 a wall using the FIG. 9 blocks with mortar joints.

FIG. 5 shows how the cement blocks 1 are laid up for an 8 foot × 12 foot panel 2 (12 blocks high 9 blocks long). The blocks are stacked with no mortar between the joints. The upper and lower surfaces of the blocks are ground flat as these are the load bearing surfaces. The stacking of the blocks may conveniently be done on a tilt table. When the stacking is completed the blocks are placed in compression both vertically and horizontally. Top to bottom loops 3, 4, 5, 6 of steel strapping spaced about two blocks apart pull the blocks inside the loops tight against each other. A peripheral loop 7 of steel strapping extends around the complete wall. Two lifting plates or bases 8 shown in enlarged scale in FIG. 6 and 7 are positioned so that nuts 9 are aligned with and extended into openings in the blocks in the lowest course. A lifting rod 11 is screwed into each nut 9 and a swivel 12 is bolted on to the upper end 13 of the rod compressing the blocks between the plate 8 and the base 14 of the swivel 12. The blocks are all now tight together and may be picked up by a sling attached to the loops 14 of the swivel.

The concrete block 1 and its companion half block 1*a* are specially designed to receive the lift rods 11 and the steel strapping for the loops 3–7 inclusive. The block 1 has two vertical pillars extending between the top and bottom surfaces of the block with center hole is large enough to loosely receive the nut 9 of the lifting plate 8. The hole 15 also provides a clearance opening for the lifting rod 11. Surrounding the center hole 15 is a surface 16 for receiving the lifting plate 8 which is shown in outline by dotted lines 17 in FIG. 3. The half block 1*a* has a single pillar 15*a* and surface 16. This means that with the block staggered as shown in FIG. 5, each lifting rod extends through pillars 15*a*. There is therefore a direct transmission of the gravity load through the pillars 15*a* and the surface 16. At opposite ends of the surfaces 16 are pairs of thrust surfaces 20*c* for steel strapping 20*a*. Of course the steel strapping does not contact every surface 20*c* as shown, but every block is capable of receiving the steel strapping. The forces exerted by the steel strapping are indicated by arrows 20*b*. The steel strapping extends through the core holes 27, 27*a* of the blocks. The core holes 27*a* are reentrant openings in the ends of the blocks of FIGS. 3 and 4. When two blocks are arranged end to end, the core holes 27*a* together make an opening equal in size to core holes 27. The core holes and the surfaces 20*c* are always in alignment when the blocks are stacked in the usual staggered joint system. The pillars 15*a* are massive enough to withstand the stresses exerted by the steel strapping which are transmitted through the full thickness of the pillars measured in a direction lengthwise of the block. The dominant stress on the pillar is compression. Stress is transmitted through struts 20*d*, 20*e* diverging from the pillars 15*a* to the front and back walls 1*a*, 1*b* of the blocks.

After the steel strapping 3 – 7 and lifting rods 11 have been installed, the blocks are rigidly positioned and clamped together under both vertical and horizontal compression and the panel may be lifted by a sling attached to the swivel loops 14 and moved to another area where opposite side surfaces of the panel are plastered with a cementfiber glass composition which seals the inner and outer surfaces of the panels and greatly increases the strength of the panel so it can withstand the tension stresses arising from either wind loads or flexual loads caused by eccentricity. After the plaster has set or cured, the panel is ready for trucking to the construction site.

Figure 1:
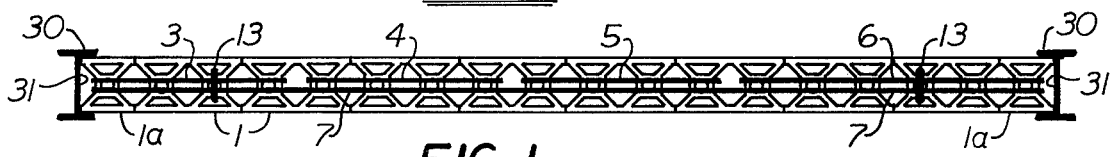
FIG. 1 is a top view of one of the panels assembled between steel I beam columns.
Figure 2:
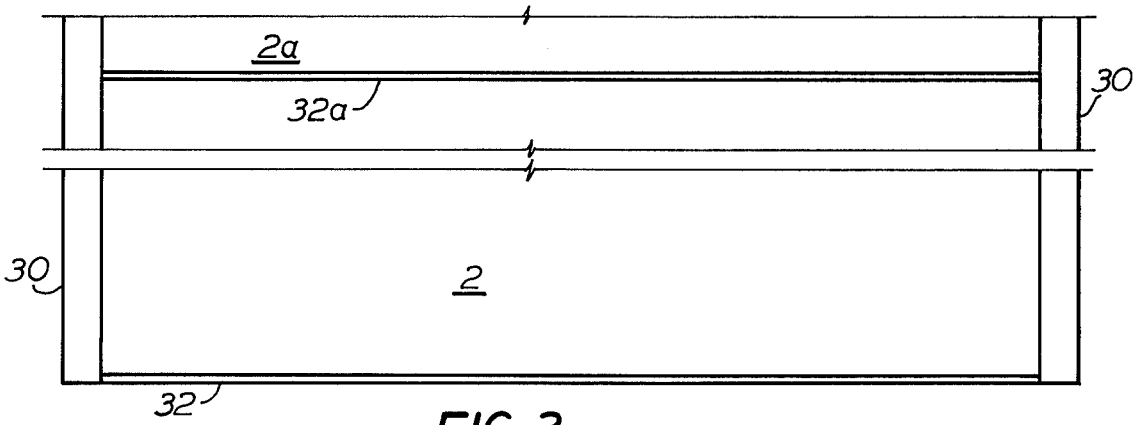
FIG. 2 is an elevation showing the joints between the panels but not the details of construction of the panels.

FIGS. 1 and 2 show the installation of the panels in a building such as a warehouse, shopping center, machine shop or other industrial or commercial building requiring walls up to 32 feet high.

First, steel I beam columns 30 are erected with channels 31 facing each other. Then panels 2 are successively dropped in place between two of the channels 31. The lower panel rests on a mortar bed 32 on the foundation 33. The next panel 2*a* rests on a mortar bed 32*a* on the top of the first panel 2. As each panel is dropped in place a mason provides the mortar bed 32, 32*a*, etc. and either grouts the panels to the I beams, or uses a continuous wood wedge to secure the panel between the flanges of the structural wide flange column. The panels are dropped in place by the same crane which positioned the steel column so that at the end of the steel erection the entire building wall is completed.

The thickness of the lifting base 8 is the thickness of the mortar joints 32, 32*a*. The excess mortar squeezes out the joint as the base bottoms. After each panel is erected the lifting rods are disconnected and the lifting bases remain permanently in the finished wall.

The use of concrete blocks is an important feature of applicant's panels. In precast concrete panels the weight of the concrete is so great that each panel must be cured in its own mold. Concrete blocks are small enough so that the blocks are removed from the machine wet and are cured outside the machine, thereby eliminating the need for a high investment in molds. At the present state of the art, the standard concrete block is 8 inches high by 16 inches long. Machines have been made for 12 × 24 inch blocks but the height of these blocks is too great to avoid sagging of the wet cement after the block is removed from the machine.

When the blocks for applicant's panel are first laid up, the application of the tension loop strapping is necessary in order that the blocks may be moved about the plant for the necessary further processing. The staggered joint system is also necessary. During the second stage of manufacture when the spray coat of glass fiber cement is applied to both the surfaces, the steel strapping permits movement of the panels from the spray area to the curing area. After being cured for three days, the panels have greatly increased strength due to the tension resisting skins of glass fiber cement. The bonding of the glass fiber to the cement and also to the interfaces of the glass fiber cement with the panel provides a tension skin which enables the panel to take all of the loads required in building construction.

Figure 3:
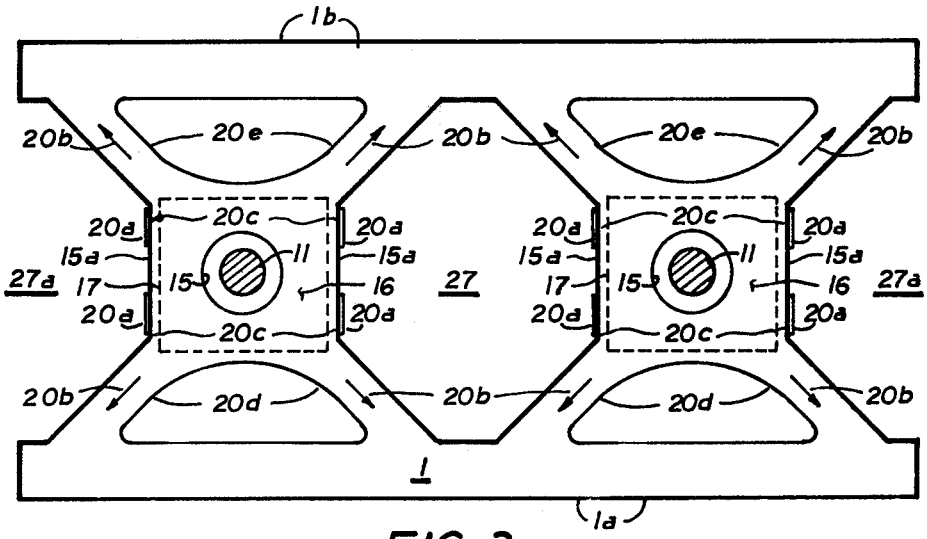
FIG. 3 is a top view of one of the concrete blocks used in the panel.
Figure 4:
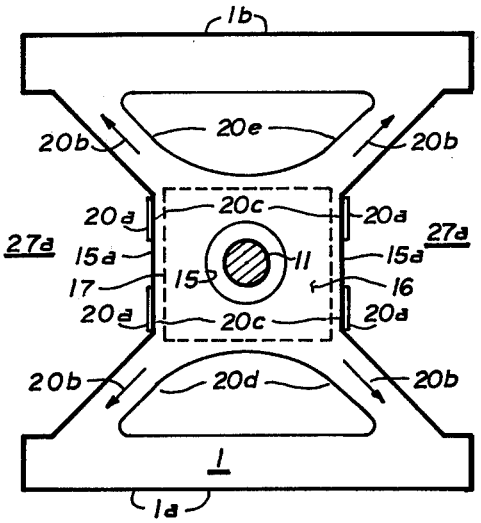
FIG. 4 is a top view of a half block for use with FIG. 3 block.

FIGS. 9 and 10 show a panel made of the blocks of FIGS. 3 and 4 which have been insulated with plastic foam board. The panels are made in various thicknesses such as 6,8,10,12 inches. The particular panel shown has a nominal wall thickness of 10 inches and consists of 6 inch concrete blocks 37 ($8 \times 15\frac{5}{8} \times 5\frac{5}{8}$), $2\frac{3}{8}$ inch urethane board blocks 35 ($8 \times 15\frac{5}{8} \times 2\frac{3}{8}$) and $1\frac{5}{8}$ inch concrete facing blocks 39 ($8 \times 15\frac{5}{8} \times 1\frac{5}{8}$). The six inch concrete blocks 37 are shown in FIGS. 3 and 4. The $1\frac{5}{8}$ inch blocks 39 are solid concrete and are for the purpose of protecting the urethane blocks 38 and also for carrying load. The urethane blocks have flat or square faces 40 on the bottom and 41 on one end and have chamfered edges or tongues 42 at the top and 43 on the other end. The concrete blocks 37 and 39 register with each other. The urethane blocks are offset both vertically and endwise relative to the concrete blocks so the tongues 42 and 43 project beyond the top and one end of the blocks so as to provide shoulders 44, 45 of the same thickness as the blocks 38 and to provide recesses 47, 48 for receiving the tongues 42, 43. The tongues facilitate alignment to the blocks and the shoulders positively align the blocks. In dry stacking, the block being laid is positioned so its tongues 42, 43 enter the recesses of previously stacked blocks. The slight resistance encountered when the shoulders 44, 45 strike the outer ends of the recesses 47, 48 serves as a signal that the block is properly aligned and can be seated by a downward and endwise force forcing the shoulders home into the recesses. There is enough clearance so that the tongues 42, 43 do not interefere with the seating of the blocks as they are stacked. The shoulders 44, 45 provide a bearing between adjoining blocks substantially equal to the thickness of the normal mortar joint.

The concrete blocks 37, 39 may be made on standard block machines. The urethane blocks 38 may be cut by saws from rigid urethane board and the tongues 42, 43 may be formed by shapers. The urethane blocks are adhered to the concrete blocks by high strength contact cements applied to both sides of the urethane blocks and to the surfaces of the concrete blocks which are to be adhered to the urethane blocks. When these cemented surfaces are brought together a unitary insulated block is immediately formed which thereafter is handled as a structural unit. The urethane blocks provide insulation (U factor 0.06) which meets or exceeds the current standards for thermal insulation.

FIGS. 9 and 10 show a wall of individual blocks laid dry and bonded by plastered skins 49, 50 of glass fiber cement. This wall requires 40% less time to erect than a wall with plain uninsulated blocks and conventional mortar joints.

In addition to being fully insulated, the wall is also fully sealed both inside and outside, by the skins 49, 50. The wall accepts or is compatible with the usual fittings or blocks for corners, windows, doors and has aligned core openings which facilitate grouting and reenforcement. The top of the wall is finished with a bond beam 51 reenforced by rods 52 embedded in a concrete grout fill 53.

The blocks 37, 38, 39 are adapted to the panels of FIG. 1–8. The wall of FIGS. 9, 10 may be made with the blocks of FIG. 12 which comprises a conventional double core 6 inch concrete block 54 ($8 \times 15\frac{5}{8} \times 5\frac{5}{8}$), $2\frac{3}{8}$ inch urethane foam block 38 ($8 \times 15\frac{5}{8} \times 2\frac{3}{8}$) and $1\frac{5}{8}$ inch concrete facing blocks 38 which are the same as blocks 39 with conventional vertical mortar grooves 54*a*. The blocks 54, 38, 39 are assembled into a unitary insulated block in the same manner as the FIG. 9 block so blocks have the same projecting tongues 42, 43 tongue receiving recesses 47, 48 and shoulders 44, 45.

Figure 12:
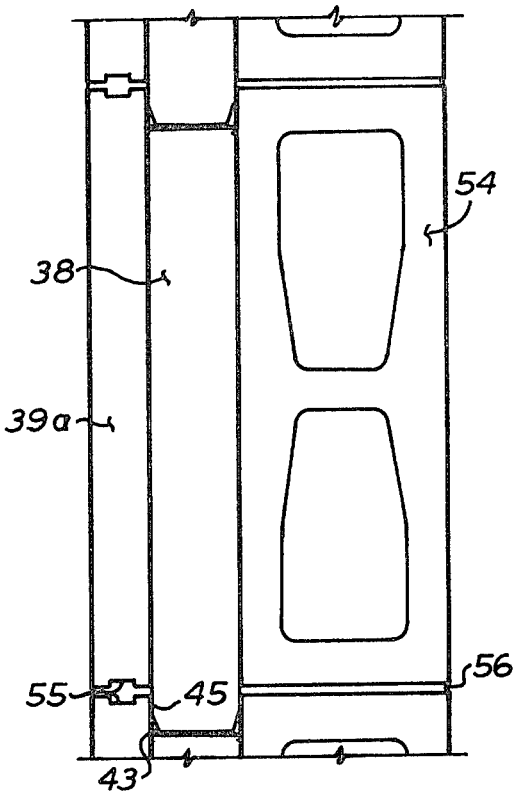

The block of FIGS. 9 and 12 can also be laid with the usual mortar joints 56 as shown in FIG. 11. The resistance encountered when the shoulders 44, 45 strike the outer ends of the recesses 47, 48 serves as a signal that the block is properly aligned and the mortar joint is the proper thickness.

I claim:

1. A prefabricated concrete block wall panel, said panel being one block thick, a plurality of blocks high and a plurality of blocks long and comprising a plurality of contiguous courses of concrete blocks with the joints between the blocks and courses dry and with the joints between blocks in adjacent courses staggered, the blocks having spaced load carrying walls with planar top and bottom load carrying surfaces and vertically aligned load carrying pillars at the centers of the blocks, the blocks having vertical core openings and thrust surfaces on said pillars within said core openings vertically aligned from top to bottom, said thrust surfaces being parallel to each other and having edges spaced inward from said walls, a plurality of tension loops at the center of the panel each surrounding a plurality of blocks both vertically and horizontally and each engaging said thrust surfaces for pulling the blocks within the loops tight against each other both vertically and horizontally and putting the blocks in compression both vertically and horizontally, the loops being spaced from each other along the length of the panel and having sides of each loop spaced apart a plurality of blocks, and struts diverging from opposite edges of said thrust receiving surfaces to said walls for transmitting load from tension loops on said thrust receiving surfaces in compression through the pillar to said walls.

2. The panel of claim 1 in which the inner and outer surfaces of the panel are coated with glass fiber cement for surface bonding the blocks.

3. The panel of claim 1 in which blocks of insulating material each have one surface adhered to the concrete blocks and the other surface adhered to a facing block of concrete.

4. The panel of claim 3 in which the surfaces of said concrete blocks and facing blocks remote from said insulating blocks are coated with glass fiber cement for surface bonding the blocks.

5. The panel of claim 3 in which the blocks of insulating material are respectively recessed inward from the bottom and one end of the said concrete blocks and project outward from the center of the other end and the top of said concrete blocks and have projecting shoulders entering the recessed bottom and end of adjoining concrete blocks of like construction for positively aligning the block with said adjoining blocks.

6. The panel of claim 1 in which one of said loops spaced along the length of the panel has a side extending through blocks within the sides of another of said loops adjoining said one loop.

7. A concrete block having spaced load carrying walls with planar top and bottom load carrying surfaces, a vertical load carrying pillar between said walls, a top to bottom core opening between opposite sides of the pillar and each end of the block, vertical thrust receiving surfaces at the center of the block and on each of said opposite sides of the pillar for tension straps extending through said core openings for pulling the block horizontally toward an adjacent block, said thrust receiving surfaces being parallel to each other and having edges spaced inward from said walls, and struts diverging from opposite edges of said thrust receiving surfaces to said walls for transmitting load from tension straps on said thrust receiving surfaces in compression through the pillar to said walls, a facing block spaced from the outer surface of one of said walls and a block of insulating material sandwiched between and adhered to said block and said outer surface of said one wall.

8. The block of claim 7 in which the blocks of insulating material are recessed inward from the bottom and one end of the block and project outward from the center end and the top of the block and having projecting shoulders entering the recessed bottom and end of adjoining blocks of like construction for positively aligning the block with said adjoining blocks.

9. A wall comprising a plurality of blocks of claim 8 with dry joints between the blocks.

10. A wall comprising a plurality of blocks of claim 8 with mortar joints between the blocks.

11. A prefabricated concrete block wall panel, said panel being one block thick, a plurality of blocks high and a plurality of blocks long and comprising a plurality of contiguous courses of concrete blocks with the joints between blocks and courses dry and with the joints between blocks in adjacent courses staggered, and means for putting all of said blocks in compression both horizontally and vertically, said panel further having facing means spaced from one surface of said panel, and insulating material sandwiched between and adhered to said one surface and to said facing means.

12. The panel of claim 11 in which the means comprises a plurality of tension strapping loops each of which surrounds a plurality of the blocks both vertically and horizontally.

13. The panel of claim 12 in which the tension loops are at the center of the panel midway between the front and back faces of the panel.

* * * * *